United States Patent [19]

Berger

[11] 4,391,440

[45] Jul. 5, 1983

[54] PORTABLE EXERCISING APPARATUS

[76] Inventor: Isaac Berger, c/o Ike Berger Enter., 263 W. 38th St., New York, N.Y. 10018

[21] Appl. No.: 232,955

[22] Filed: Feb. 9, 1981

[51] Int. Cl.[3] ..... A63B 21/06

[52] U.S. Cl. ..... 272/118

[58] Field of Search ..... 272/117, 136, 138, 142, 272/143, 130, 118

[56] References Cited

U.S. PATENT DOCUMENTS

| | | | |
|---|---|---|---|
| 167,137 | 8/1875 | Tieout | 272/117 |
| 190,150 | 5/1977 | Lozier | 272/117 |
| 190,503 | 5/1877 | Lozier | 272/117 |
| 1,372,026 | 5/1921 | Hutter . | |
| 1,623,671 | 4/1927 | Frankenfeld . | |
| 3,056,603 | 10/1962 | Levine et al. . | |
| 3,115,339 | 12/1963 | Forte | 272/117 |
| 3,369,809 | 2/1968 | Morrill . | |
| 3,834,694 | 9/1974 | Pridgen . | |
| 3,995,853 | 12/1976 | Deluty . | |
| 4,077,626 | 3/1978 | Newman . | |

*Primary Examiner*—Richard C. Pinkham
*Assistant Examiner*—William R. Browne
*Attorney, Agent, or Firm*—Kirschstein, Kirschstein, Ottinger & Cobrin

[57] ABSTRACT

A portable lightweight body-anchored exercising apparatus for use in exercising the human body made up of a frame, a pair of ropes with free ends pullable by a user, weights for resisting the pulling forces, and a base connected to the frame and on which the user rests his body during performance of exercises to hold the apparatus in place so that it does not move in response to the generally upward forces created by the pulling of ropes by the user. Additionally, the exercising apparatus includes a pulley system to permit the user to move his exercising limbs a distance greater than the excursion of the weights, handles for the user to grasp while pulling the ropes, sheaves for controlling the movement of the ropes, and guide pins for guiding the weights so that they cannot swing outwardly and harm the user. The weights are attached to the ropes with hooks to allow them to move jointly with the ropes.

12 Claims, 7 Drawing Figures

PORTABLE EXERCISING APPARATUS

BACKGROUND OF THE INVENTION

1. Field of the Invention

The present invention generally relates to an exercise apparatus, and more particularly to a portable, lightweight, body-anchorable exercise apparatus.

2. Description of the Prior Art

The concept of utilizing the body weight of a user to secure an exercising apparatus in place is known in the art.

U.S. Pat. No. 3,369,809 discloses an exercising device with a platform that the user stands upon to anchor the device against the floor. The device does not include any resistance means.

Although the afore-mentioned type of exercise device is satisfactory for its intended purposes, the lack of resistance means limits the type of exercises a user may perform. Without the inclusion of any resistance means, the only resistance in the system is dependent upon the user's own efforts.

U.S. Pat. No. 3,834,694 discloses an exercise apparatus for exercising leg muscles. The apparatus includes a pad on which the user lies while using the exercise apparatus. The apparatus has a pair of pulleys and weights. The user lifts the weights through a pulley system while lying on the mattress. Although useful for its intended purposes, the apparatus of this patent is useful only for exercising thigh, hamstring and groin muscles.

U.S. Pat. No. 3,995,853 discloses an exercise apparatus with a hand grip that can be pulled against an adjustable internal resistance. The apparatus is attached to a footrest upon which the user stands to stabilize the apparatus. The footrest in this system is optional and the system may be permanently attached to fixed supports. The exercise apparatus contains only a single pull cord and resistance system, hence the user must move both arms in the same direction or only one arm at a time.

Other patents in this area are U.S. Pat. Nos.: 1,372,026; 1,623,671; 3,056,603; and 4,077,626.

SUMMARY OF THE INVENTION

1. Objects of the Invention

It is an object of the invention to provide an exercise apparatus and a method of exercising which avoid the disadvantages of prior art exercise devices.

It is another object of the invention to provide an exercise apparatus which is lightweight and portable.

It is still another object of the invention to provide an exercise apparatus which is held in position during exercising by the user's own body weight.

Yet another object of the invention is to allow a user to exercise against the force of varying resistance.

Still a further object of the invention is to allow a user to move his arms in different directions from one another.

It is still a further object of the invention to guide various components of the exercise device along a predetermined path during the act of exercising.

Yet a further object of the invention is to allow the user's body to move through a distance substantially greater than the distance through which the resistance of the exercise apparatus moves.

Other objects of the invention in part will be obvious and in part will be pointed out hereinafter.

2. Features of the Invention

In keeping with these objects, and others which will become apparent hereinafter, one feature of this invention resides, briefly stated, in a lightweight, portable, exercise apparatus with resistance means which is secured in place by a user's own body weight. A user can move the apparatus from place to place with no difficulty and does not have to provide extra means for securing the apparatus in position while he is exercising with the same.

Another feature of this invention resides in the inclusion of a pulley system in the exercise apparatus. The pulley system creates a mechanical advantage which permits a user to move his body through a distance which is significantly greater than the distance through which the resistance means of the apparatus must move.

In a preferred embodiment, the exercise apparatus includes ropes. The ropes are operatively attached both to the resistance means and to access handles for the user to grasp. The access handles are positioned at approximately upper-thigh level when the apparatus is not in use. By so positioning the access handles, a user can perform a variety of different movements.

In a preferred embodiment the apparatus includes guide means for guiding the resistance means as it moves during the performance of exercise. The guide means thus provides a safety feature, insuring that the resistance means will not swing out and strike the user.

In this way a user can exercise wherever he so desires and is not restricted to exercising in one place because his exercise apparatus is permanently secured in said one place or because his exercise apparatus is too heavy to move from place to place. The user can also perform a variety of different exercise movements and need not worry about being struck by part of the exercise apparatus. Further the exercise apparatus will not move as a result of the generally upward forces created by the act of exercising with the apparatus.

DETAILED DESCRIPTION OF THE PREFERRED EMBODIMENTS

Figure 1:
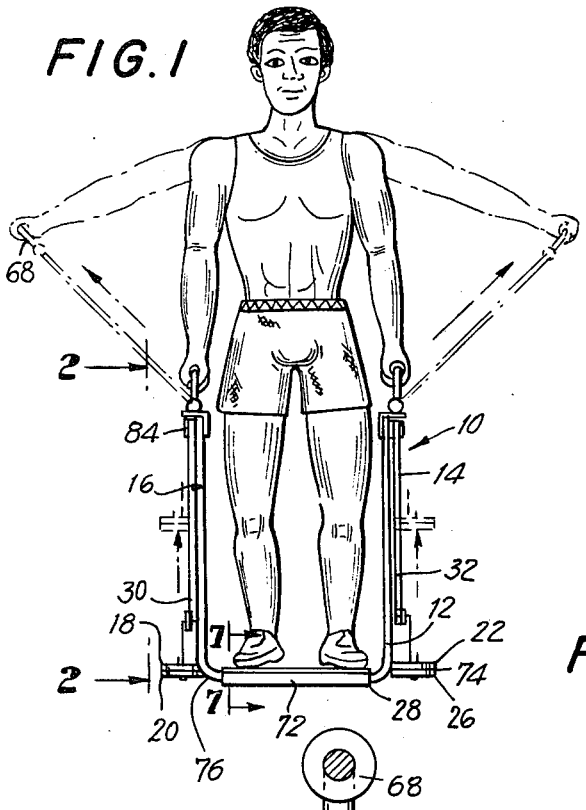
FIG. 1 is a perspective view of the exercise apparatus of the present invention being used in accordance with the method of the present invention.

Referring now in detail to the drawings, the reference numeral 10 denotes the exercise apparatus of the present invention. Said exercise apparatus has a light-weight rigid frame portion 12. A pair of elongated, flexible exercising means, i.e. ropes, 14, 16 are mounted on the frame portion 12. The ropes 14, 16 are axially movable along their axes of elongation in relation to the frame portion 12.

As best seen in FIG. 1, ropes 14, 16 are capable of being pulled by a user for exercise purposes. The ropes 14, 16 when pulled upwardly by a user generate a substantially upward force on the frame portion 12.

The exercise apparatus includes a plurality of resistance means. In a preferred embodiment the resistance means are weights. Weights 18, 20, 22, 26 are exemplary of all weights capable of being used with the preferred embodiment. The weights 18, 20, 22, 26 resist the lifting forces on the ropes 14, 16 generated by the user. Although weights are used in a preferred embodiment, any other appropriate means of resisting the pulling force may be used. An example of another such appropriate resistance means is a spring system.

A base 28, is connected to the frame 12. When exercising with the exercise apparatus 10, in accordance with the method of the present invention, a user rests his body weight on the base 28. As illustrated in FIG. 1, a user may stand on the base 28. A user may also sit on the base 28, lie on the base 28, or rest any other appropriate portion of his body on said base 28.

The base 28 will exert a force opposing the force of the pulled ropes 14, 16 when a user's weight is so applied to said base 28. The base permits the user to place the exercise apparatus 10 anywhere on a floor while exercising, utilizing only his own body weight. Thus, a user need not utilize external supports, e.g. bolts. The apparatus remains easily movable without any loss of stability.

The exercise apparatus 10 includes two pulley systems 30, 32. Each pulley system 30, 32 is operatively associated with the appropriate weights 18, 20, 22, 26 and the appropriate rope 14, 16. Because the two pulley systems are identical, only pulley system 10 is detailed herein.

The pulley systems 30, 32 provide the exercise apparatus with a 3 to 1 mechanical advantage. This mechanical advantage permits the user to move his body through a distance which is significantly larger than the distance through which the weights 18, 20, 22, 26 must move thus making it possible to keep the exercise apparatus 10 compact without significantly limiting the user's movement during the act of exercising.

Figure 2:
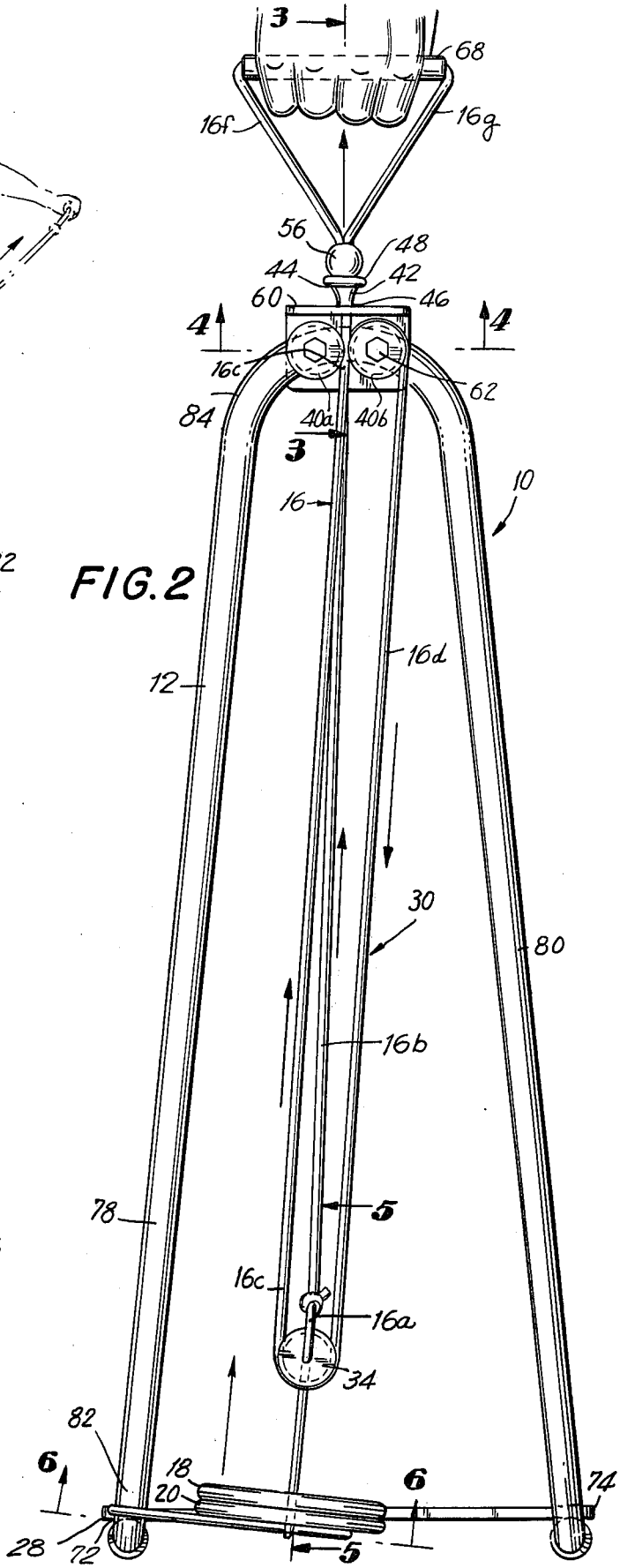
FIG. 2 is a side elevational view of the exercise apparatus taken essentially along line 2—2 of FIG. 1.
Figure 3:
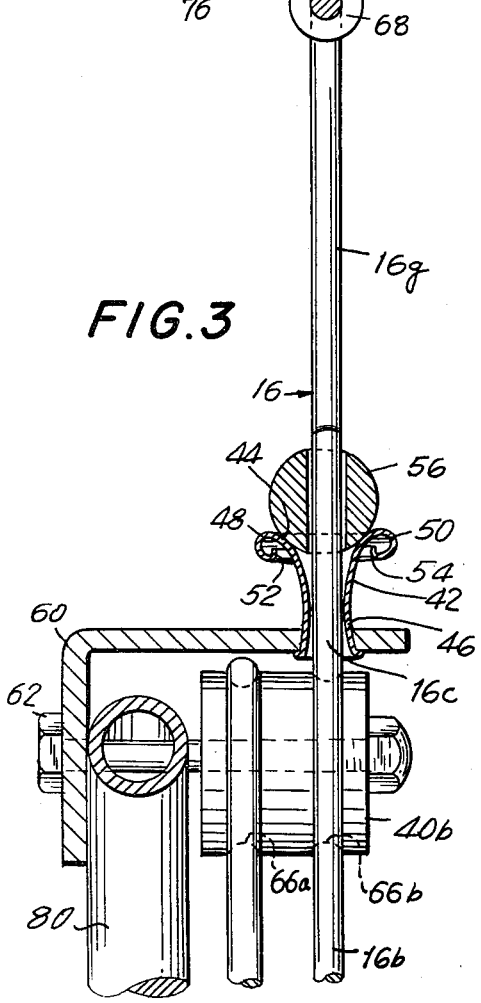
FIG. 3 is an enlarged vertical sectional view taken essentially along line 3—3 of FIG. 2.
Figure 4:
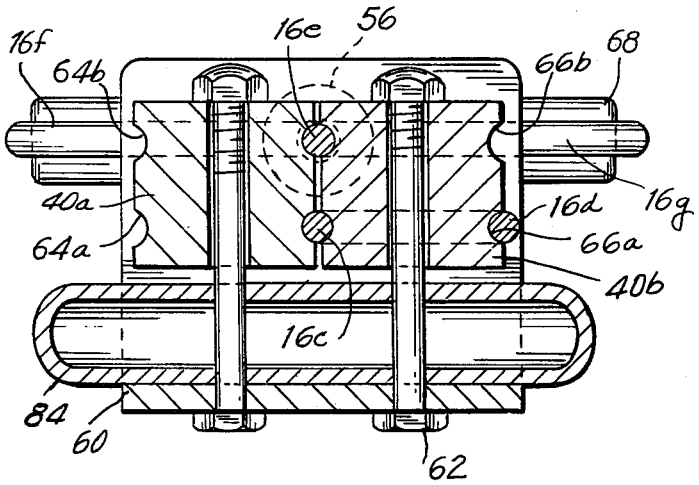
FIG. 4 is an enlarged horizontal sectional view taken essentially along line 4—4 of FIG. 2.

As best seen in FIG. 2, the pulley system 30 comprises a lower sheave 34 which is rotatable about a horizontal axis and a pull rope 16. The pull rope 16 has a lower first end 16*a* which is tied onto an upper horizontal leg 36 of an S-shaped hook 38. S-shaped hook 38 is operatively connected to weights 18 and 20. Extending upwardly from free end 16*a* is a first flight 16*b*. First flight 16*b* has an upper portion 16*c* which extends between two adjacent upper sheaves 40*a* and 40*b*. Upper sheaves 40*a* and 40*b* are rotatable about a horizontal axis. The rope 16 is trained about sheave 40*b* to form a second flight portion 16*d* which extends downwardly from sheave 40*b* and is then trained about lower sheave 34. From lower sheave 34, rope 16 continues upwardly into a third flight portion 16*e*. Flight portion 16*e* proceeds into and through guide funnel 42. Guide funnel 42 has an upper flared end 44 and a lower narrow end 46. Flight portion 16*e* enters into bottom end 46 and extends upwardly through top end 44. Bottom end 46 is sufficiently large enough to allow flight portion 16*e* to freely enter therethrough. Top end 44 is sufficiently flared to allow flight section 16*e* to extend without interference therefrom at a variety of angles.

Top end 44 of guide funnel 42 is constructed with an outwardly angled, beaded rim 48, to avoid sharp edges touching the rope 16.

A knob 56 is secured to the upper end of the rope to limit downward movement of this end by abutment against the funnel. Upper sheave wheels 40*a* and 40*b* and guide funnel 42 are mounted on the frame 12 with an L-shaped bracket 60, held in place by bolts 62. Knob 56 is situated above bracket 60. Upper sheaves 40*a* and 40*b* are each formed with two annular grooves therein 64*a*, 64*b*, 66*a*, 66*b* that act as guides for the ropes.

After rope 16 extends upwardly out of guide funnel 42, it engages a grasp handle 68 which serves as a means for gripping rope 16. In a preferred embodiment, handle 68 together with two handle rope segments 16*f* and 16*g* defines a traingle which is dimensioned so that an adult user may easily fit his hand over the handle 68 and between rope segments 16*f* and 16*g*. Handle 68 is constructed of any appropriate material, e. g. wood, which will allow a user a firm non-slipping grasp on same.

Figure 5:
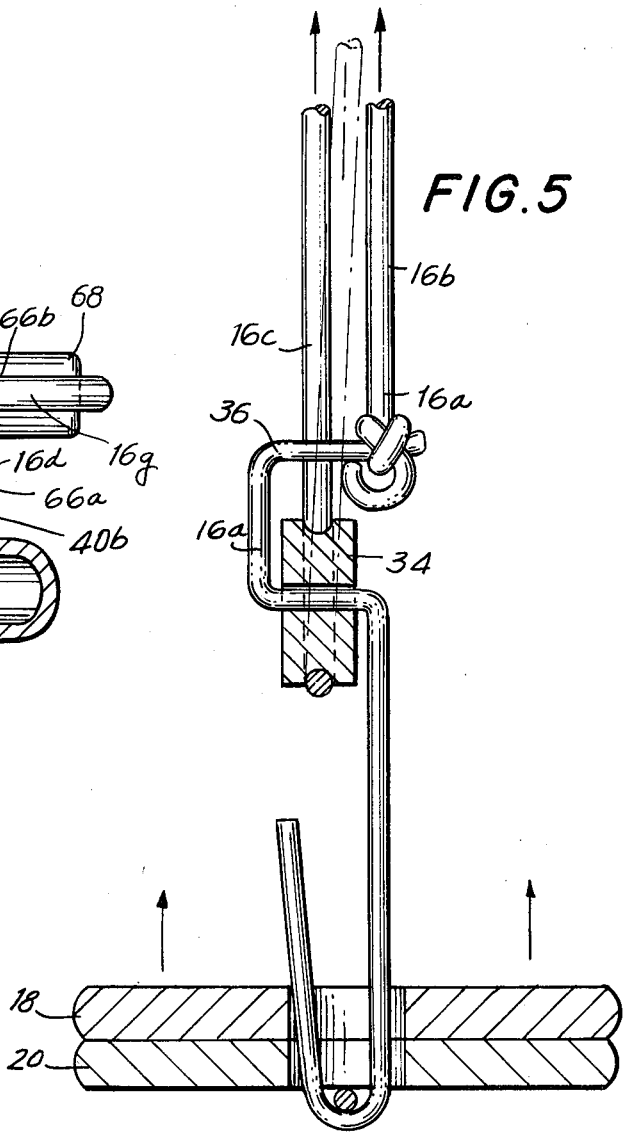
FIG. 5 is a vertical sectional view taken essentially along line 5—5 of FIG. 2.
Figure 7:
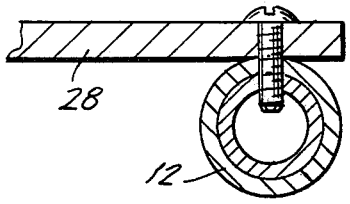
FIG. 7 is a vertical sectional view taken essentially along line 7—7 of FIG. 1.
Figure 6:
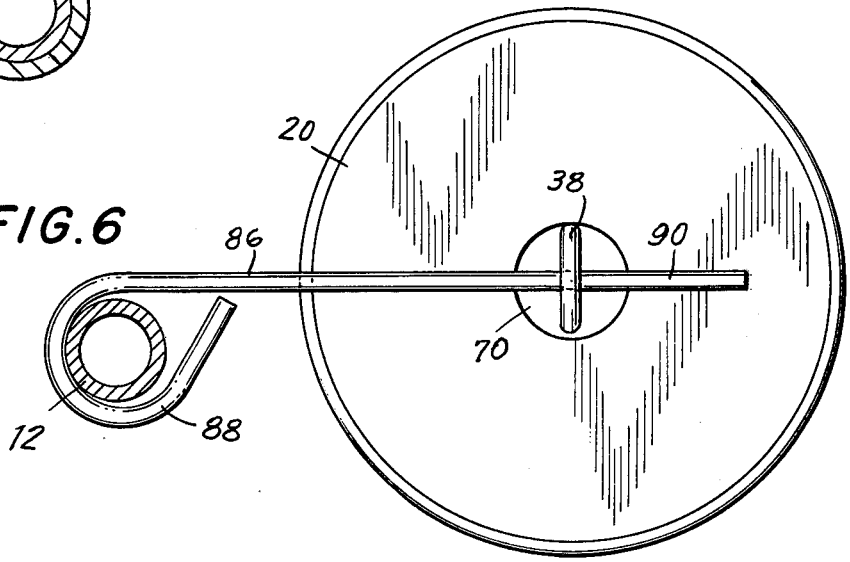
FIG. 6 is a generally horizontal sectional view taken essentially along line 6—6 of FIG. 2.

As best seen in FIG. 5, the weights 18, 20, 22, 26 are attached on the ropes 14, 16 with S-shaped hook 38. Although there are two identical hooks, one for each rope and associated other components, only hook 38 and its associated components are detailed herein.

Hook 38 extends through weights 18, 20. The hook may be attached simultaneously to any number of weights so that the resistance force is easily varied. The weights of which 18, 20 are examples, are each formed with a hole 70 through their centers. The hook 38 is threaded through the holes 70 and in that manner the weights 18 and 20 are attached to the exercise apparatus 10. Hook 38 allows weights 18 and 20 to move jointly with rope 16. As heretofore detailed, rope 16 has a portion 16*a* which is tied about hook 38.

The base 28 in a preferred embodiment is an elongated broad platform constructed of any appropriate material. It must be lightweight so as not to unnecessarily increase the weight of the entire exercise apparatus 10, and it also must be strong enough to support the weight of an adult user. The base 28 is appropriately dimensioned to comfortably support the user during exercise and is constructed of a material off which a user will not easily slip.

The base 28 has two ends 72, 74. The frame portion 12 is attached to these two ends.

The lightweight frame portion 12 of the exercise apparatus 10 consists of a bottom portion 76 which is attached to the base 28, and two erect, elongated, tubular, inverted, generally U-shaped members 78 and 80. The members 78 and 80 are at opposite sides of the bottom portion 76. The user when positioned on the bottom portion 76 has a different U-shaped member on either side of his body. That is to say, the user places his body between U-shaped members 78 and 80.

The entire frame 12 may be constructed of any lightweight, durable material which will not add excessive weight to the exercise apparatus 10 but which will withstand the forces generated by the act of exercising.

Each U-shaped member 78 and 80 has a bottom end 82 secured to the bottom portion 76 and a top end 84. Each top end 84 of the U-shaped members is at approximately the upper-thigh level of an adult user. The height of the top end 84 allows the user a wide variety of movements. As detailed heretofore, there is included in the exercise apparatus 10 a guide funnel 42 with associated knob 56 and bracket 60. The funnel 42, knob 56, and bracket 60 are situated at the top end 84 of the U-shaped members 78 and 80.

There further is provided a guide pin 86 for guiding the weights, 18, 20, 22, 26 as they move upwardly in response to the user's pulling action on ropes 14 and 16. Guide pin 86 is formed with a looped end 88. Looped end 88 is utilized to attach guide pin 86 to the end 74 of the frame 12 for sliding movement along same.

Guide pin 86 is further formed with an end 90 for retaining the guide pin 86 on the hook 38.

A user may perform a wide variety of exercise activities utilizing the exercise apparatus 10. The user places an appropriate portion of his body on the base 28 so that his weight anchors the exercising apparatus 10 in position. The user then grasps the handles 64 and pulls thereon in a generally upward direction and in any desired directions. This lifting action moves the ropes 14, 16 against resistance force created by the weights 18, 20, 22, 26.

There are an infinite variety of exercise movements that a user may perform with exercise apparatus 10. The user is not restricted to pulling the ropes 14, 16 with his arms but may put his feet through the triangles formed by handle 68 and handle segments **16*f* and 16*g* and thereby exercise his legs. The user may move two limbs in either the same or in different directions due to the provision of two separate and distinct ropes 14 and 16 and two separate and distinct pulley systems 30, 32. The user is permitted a large amount of movement due to the 3 to 1 mechanical advantage created by the pulley systems 30, 32**.

As various possible embodiments might be made of the above invention, and as various changes might be made in the embodiment set forth, it is to be understood that all matters herein described and shown in the accompanying drawings are to be interpreted as illustrative and not in a limited sense.

I claim:

1. A portable, body-anchored exercising apparatus, comprising:

(a) an erect vertically elongated rigid frame;

(b) a pair of separate elongated, flexible ropes mounted on and being axially movable along their axes of elongation in relation to the frame at opposite sides thereof, said ropes being capable of being pulled by a user for exercise purposes, and said ropes generating a substantially upward force on the frame when so pulled, each rope of said pair of ropes having a grasp end which when idle is situated at approximately mid-body level of an adult user;

(c) separate means for resisting the pulling forces on the ropes generated by the user;

(d) a pair of separate pulley systems, each pulley system being operatively interposed between a different resistance means and an associated rope, each pulley system including at least two vertically spaced pulleys about which the associated rope is trained, the upper pulley being rotatably supported by the rigid frame and the lower pulley being rotatably supported by the associated rope, the lower pulley supporting the associated resistance means, whereby the apparatus is provided with a mechanical advantage greater than 1 to 1 in favor of the grasp ends, the mechanical advantage allowing the user to move the grasp ends through a distance greater than the distance through which the associated resistance means moves; and (e) a base connected to the frame and on which the user rests his body weight while exercising on the same, said base exerting a force opposing the force of the pulled ropes, when the user's weight is applied to said base, said base being operative for permitting the user to hold the apparatus down using his own body weight in any desired position while exercising.

2. The body-anchored exercising apparatus of claim 1, wherein the mechanical advantage provided is 3 to 1.

3. The body-anchored exercising apparatus of claim 1, wherein the resistance means comprises weights attachable to the ropes with a hook for allowing the weights to move jointly with the lower pulley.

4. A portable, body-anchored exercising apparatus, comprising:

(a) an erect vertically elongated rigid frame;

(b) a pair of separate elongated, flexible ropes mounted on and being axially movable along their axes of elongation in relation to the frame at opposite sides thereof, said ropes being capable of being pulled by a user for exercise purposes, and said ropes generating a substantially upward force on the frame when so pulled, each rope of said pair of ropes having a grasp end which when idle is situated at approximately mid-body level of an adult user;

(c) separate means for resisting the pulling forces on the ropes generated by the user;

(d) a pair of separate pulley systems, each pulley system being operatively interposed between a different resistance means and an associated rope, each pulley system including at least two vertically spaced pulleys about which the associated rope is trained, the upper pulley being rotatably supported by the frame and the lower pulley being rotatably supported by the associated rope, the lower pulley supporting the associated resistance means, whereby the apparatus is provided with a mechanical advantage greater than 1 to 1 in favor of the grasp ends, the mechanical advantage allowing the user to move the grasp ends theough a distance greater than the distance through which the associated resistance means moves;

(e) a base connected to the frame and on which the user rests his body weight while exercising on the same, said base exerting a force opposing the force of the pulled ropes, when the user's weight is applied to said base, said base being operative for permitting the user to hold the apparatus down using his own body weight in any desired position while exercising;

(f) said frame further including (i) a bottom portion attached to said base and (ii) two erect vertically elongated inverted U-shaped members at opposite sides of the bottom portion, (ii) each of the inverted U-shaped members having a bottom end mounted on the bottom portion, and a top end.

5. The body-anchored exercising apparatus of claim 4, wherein the top ends of the inverted U-shaped members are at approximately upper-thigh level of an adult user.

6. The body-anchored exercising apparatus of claim 5, wherein the ropes of said pair of ropes extend upwardly through the top ends of the inverted U-shaped members.

7. The body-anchored apparatus of claim 4, wherein an upwardly flaring funnel is mounted on the top end of each inverted U-shaped member for guiding the associated ropes during pulling of the same.

8. The body-anchored exercising apparatus of claim 7, wherein each ropes of said pair of ropes extend upwardly through each associated funnel.

9. A portable, body-anchored exercising apparatus, comprising:

(a) an erect vertically elongated rigid frame;

(b) a pair of separate elongated, flexible ropes mounted on and being axially movable along their axes of elongation in relation to the frame, said ropes being capable of being pulled by a user for exercise purposes, and said ropes generating a substantially upward force on the frame when so pulled, each rope of said pair of ropes having a grasp end which when idle is situated at approximately mid-body level of an adult user;

(c) separate means for resisting the pulling force on the ropes generated by the user;

(d) a pair of separate pulley systems, each pulley system being operatively interposed between a different resistance means and an associated rope, each pulley system including at least two vertically spaced pulleys about which the associated rope is trained, the upper pulley being rotatably supported by the frame and the lower pulley being rotatably supported by the associated rope, the lower pulley supporting the associated resistance means, whereby the apparatus is provided with a mechanical advantage greater than 1 to 1 in favor of the grasp ends, the mechanical advantage allowing the user to move the grasp ends through a distance greater than the distance through which the associated resistance means moves;

(e) a base connected to the frame and on which the user rests his body weight while exercising on the same, said base exerting a force opposing the force of the pulled ropes, when the user's weight is applied to said base, said base being operative for permitting the user to hold the apparatus down using his own body weight in any desired position while exercising;

(f) the exercising apparatus additionally comprising a pair of means for guiding the resistance means along predetermined paths during movement of the resistance means; and (g) the pair of guide means being mounted on the frame for movement along the vertical length of the frame.

10. The body-anchored exercising apparatus of claim 9, wherein the frame includes two rectilinear erect members, the resistance means constitutes a plurality of weights each formed with a hole therethrough, and further comprises a hook portion insertable through the holes in the weights and extending beyond said holes.

11. The body-anchored exercising apparatus of claim 10, wherein each means for guiding the resistance means is a guide pin comprising:

(a) a looped end portion for attaching each means for guiding the resistance means around one rectilinear erect member of the frame for movement therealong; and (b) a retention portion operatively connected to the hook portion, for retaining the weights on the hook portion.

12. The body-anchored exercising apparatus of claim 1, wherein the ropes are movable in infinitely variable different directions.

* * * * *